United States Patent [19]

Troup

[11] 4,140,278

[45] Feb. 20, 1979

[54] OSCILLATING WAVE LAWN SPRINKLER

[75] Inventor: Edward M. Troup, Mount Baldy, Calif.

[73] Assignee: Rain Bird Sprinkler Mfg. Corporation, Glendora, Calif.

[21] Appl. No.: 816,316

[22] Filed: Jul. 18, 1977

[51] Int. Cl.[2] ..... B05B 3/16

[52] U.S. Cl. ..... 239/242; 285/2

[58] Field of Search ..... 239/242; 285/1, 2, 304

[56] References Cited

U.S. PATENT DOCUMENTS

| | | | |
|---|---|---|---|
| 2,546,241 | 3/1951 | Squiers | 239/242 |
| 3,073,532 | 1/1963 | Rinkewich | 239/242 |
| 3,105,639 | 10/1963 | Jepson | 239/242 |
| 3,115,305 | 12/1963 | Rinkewich | 239/242 |
| 3,220,655 | 11/1965 | Mattson | 239/242 |

*Primary Examiner*—Robert W. Saifer

*Attorney, Agent, or Firm*—Fulwider, Patton, Rieber, Lee & Utecht

[57] ABSTRACT

An oscillating wave type lawn sprinkler having a spray tube that is angularly oscillated about its axis by a spray tube linkage assembly that is driven by a water-actuated motor. The linkage assembly is coupled to the spray tube by a releasable coupling that disengages whenever the spray tube is subjected to an external force which exceeds a predetermined magnitude, thereby permitting the spray tube to angularly deflect out of its normal alignment. Normal alignment of the spray tube is restored by manually rotating the spray tube until the coupling is again engaged.

10 Claims, 7 Drawing Figures

OSCILLATING WAVE LAWN SPRINKLER

BACKGROUND OF THE INVENTION

This invention relates to lawn sprinklers and, more particularly, to oscillating wave type lawn sprinklers.

The oscillating wave type lawn sprinkler has met with widespread acceptance by the purchasing public. The design has proven popular because it provides portability and flexibility, allowing manual selection from a variety of patterns of spray coverage. Additionally, sprinklers of this general type are operable over a wide range of water pressures and are capable of sprinkling water evenly over a relatively large coverage area.

An oscillating wave lawn sprinkler available prior to this invention typically had an arcuate spray tube which was angularly oscillated on an axis defined by the tube's end portions. The oscillation was effected by spray tube linkage means that were driven by a water-actuated motor. The motor typically had a water driven impeller and a reduction gear train located in a housing through which the water to be sprinkled was first passed. The spray tube was rigidly secured to the linkage means.

A major drawback to the aforedescribed prior art devices was that they frequently were damaged when accidentally dropped or otherwise subjected to substantial external forces. The spray tubes, being rigidly connected to the linkage means and therefore not being capable of yielding easily to such forces, were frequently bent irreparably. Moreover, the spray tube linkage means were often damaged by such external forces.

It will be appreciated from the foregoing that there is a definite need for an oscillating wave lawn sprinkler that is better able to withstand damage to its spray tube when subjected to accidental dropping or other external forces. The present invention fulfills this need.

SUMMARY OF THE INVENTION

The present invention resides in a unique oscillating wave type lawn sprinkler that has releasable coupling means allowing the spray tube to yield to substantial external forces, such as those which result when the sprinkler is accidentally kicked or dropped.

More particularly, a lawn sprinkler constructed in accordance with the present invention includes a base for placement on or adjacent an area to be sprinkled, a spray tube support arbor at one end of the base and a motor housing at the other end. The motor housing has a water inlet and a water outlet, and an arcuate spray tube is journaled at one end in the water outlet of the motor housing and at the other end on the support arbor.

A water-actuated motor is located within the motor housing and includes an impeller, a reduction gear train and a drive shaft. A spray tube linkage assembly, driven by the motor drive shaft, controls the spray tube's angular orientation, causing it to rotate in an oscillating fashion and thereby, to sprinkle water over a predetermined coverage area.

The spray tube linkage assembly is coupled to the spray tube by releasable coupling means which permit the spray tube to angularly deflect out of from its normal alignment relative to the linkage assembly, whenever the tube is subjected to an external rotational force exceeding a predetermined magnitude. The releasable coupling means includes a detent, which is normally engaged, for maintaining the spray tube in proper alignment. When the spray tube is subjected to a force of potentially damaging magnitude, the detent disengages and the spray tube is free to angularly deflect on its axis, thereby substantially reducing the possibility of damage. The deflected spray tube is restored to its normal operational alignment by manually rotating it relative to the linkage assembly, until the detent is again engaged.

It will be appreciated from the foregoing that the present invention represents a significant advance in the design of lawn sprinklers. In particular, it provides an oscillating wave type lawn sprinkler having a spray tube that is capable of being subjected to substantial external forces, without incurring damage. Other aspects and advantages of the invention will become apparent from the following detailed description taken in conjunction with the accompanying drawings which disclose, by way of example, the principles of the invention.

DESCRIPTION OF THE PREFERRED EMBODIMENT

Figures 1, 2, 3, 4, 5, 6, 7:
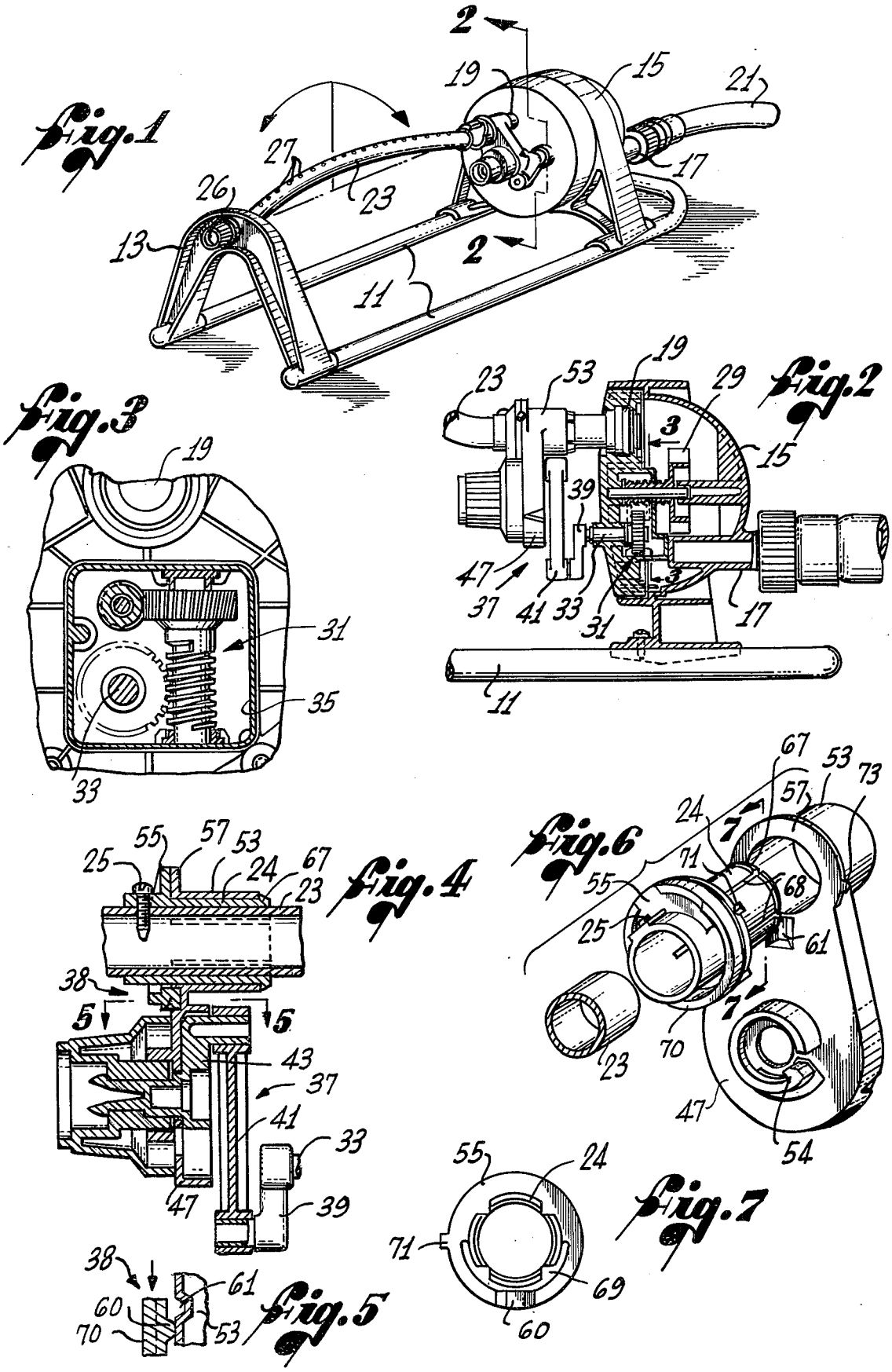
FIG. 1 is a perspective view of a lawn sprinkler embodying the present invention, as it is disposed on or adjacent a surface to be watered.
FIG. 2 is a sectional elevational view of the motor housing, motor and spray tube linkage assembly of the sprinkler, taken substantially along the line 2—2 in FIG. 1.
FIG. 3 is a sectional view of the reduction gear train located within the motor housing, taken substantially along the line 3—3 in FIG. 2.
FIG. 4 is a sectional view of the spray tube linkage assembly and the releasable coupling means.
FIG. 5 is a fragmentary sectional view of the detent portion of the releasable coupling means, taken substantially along the line 5—5 in FIG. 4.
FIG. 6 is an exploded perspective view of the releasable coupling means, coupling the spray tube sleeve to the spray tube crank portion of the linkage assembly.
FIG. 7 is an end view of the sleeve, taken along line 7—7 in FIG. 6.

As shown in the exemplary drawings, the present invention is embodied in a lawn sprinkler having an oscillating spray tube driven by a water-actuated motor. As can be seen in FIG. 1, the lawn sprinkler of the present invention includes a base 11, with a spray tube support arbor 13 secured on one end and a motor housing 15 secured on the other end. The housing 15 is formed with a water inlet 17 and a water outlet 19, whereby water is allowed to flow therethrough. The water inlet 17 is adapted for connection of a conventional garden hose 21.

The sprinkler includes a spray tube assembly having an arcuate spray tube 23 and a sleeve 24. The spray tube is journaled at one end in the water outlet 19 in the motor housing 15 and at the other end in the arbor 13. The respective ends of the spray tube are disposed substantially equidistant above the base 11, with the central portion of the spray tube disposed slightly higher. The sleeve 24, generally cylindrical in shape, encircles a portion of the spray tube near the housing 15. Herein, the sleeve is secured to the spray tube by a self-tapping screw 25 and a plug 26 seals the spray tube end which is journaled in the arbor 13.

A plurality of water outlet ports 27 are located at substantially equally spaced intervals along the top side of the spray tube 23. Thus water is allowed to flow through the housing 15, via the water inlet 17 and the water outlet 19, and into the spray tube 23 where it is ported through the outlet ports 27.

As can be seen in FIG. 2, located within the motor housing 15 is a water-actuated motor for converting a portion of the kinetic energy of the water flowing through the housing 15 into mechanical rotational energy. The motor includes a turbine or impeller 29, a reduction gear train 31 of conventional type, and a drive shaft 33.

The impeller 29 is disposed within the housing 15 so that the flow of water therethrough causes the impeller to rotate. The reduction gear train 31, which is driven by the impeller 29, is coupled to the drive shaft 33, and turns the shaft at a rotational velocity that is substantially reduced from that of the impeller. The reduction gear train 31 is located in a water-tight chamber 35 that is formed in the housing 15, and the drive shaft 33 is journaled in a wall of the housing to extend outwardly therethrough. A spray tube linkage assembly 37, coupled between the drive shaft 33 and the spray tube 23, transmits the rotational motion of the shaft to the spray tube, to angularly oscillate the tube in its journal mountings.

In accordance with the present invention, the spray tube linkage assembly 37 is coupled to the sleeve 24 of the spray tube assembly by releaseable coupling means. This coupling permits the sleeve and spray tube to angularly deflect out of its normal alignment whenever the tube is subjected to a substantial external rotational force. The releasable coupling means includes a detent 38, which is normally engaged, for maintaining the spray tube's proper alignment. The detent yields to substantial external forces by disengaging and allowing the spray tube to deflect away, thereby reducing significantly the likelihood of damage.

As can be seen in FIGS. 2 and 4, the linkage assembly 37 includes a drive crank 39, a connecting arm 41, a control crank 43, and a spray tube crank 47. Preferably, the sleeve and the component parts of the linkage assembly are made of a lightweight, low friction material having a limited degree of resilience, such as plastic.

The spray tube crank 47 includes a generally cylindrically shaped jacket portion 53 which encircles the sleeve 24, in close bearing engagement. The jacket portion 53, serves as a pivot on which the spray tube crank 47 oscillates. In accordance with conventional sprinkler design techniques, the control crank 43 is secured to the spray tube crank 47 by a manually controllable ratchet 54. This ratchet controls the relative orientations of the two cranks, thereby permitting a selection of the oscillation angle of the spray tube 23, and thus the sprinkler's pattern of spray coverage.

The drive crank 39, which is driven by the drive shaft 33, is connected to the control crank 43 by the connecting arm 41. Rotational motion of the drive crank, then, effects an angularly oscillatory motion in the control crank and spray tube crank 47, about the axis of rotation of the spray tube 23.

The releasable coupling means of the present invention couples the spray tube crank 47 to the sleeve 24. The releasable coupling means includes first and second collars 55 and 57 and a detent 38. The first collar 55 is substantially flat and ring shaped and is integral with one end of the sleeve 24, extending radially outwardly therefrom. Similarly, the second collar 57 is substantially flat and ring shaped and is integral with the corresponding end of the jacket 53, extending radially outwardly therefrom in abutting relationship with the first collar.

The end of the sleeve 24 that is opposite the end on which the first collar 55 is located, includes an outwardly projecting annular shoulder portion 67 that abuts the corresponding end of the jacket 53. This shoulder cooperates with the first collar to prevent the jacket from sliding axially along the sleeve. This prevention from axial sliding enables an abutting face of the second collar 57 to be maintained in abutment with an abutting face of the first collar 55.

The sleeve 24, including the annular shoulder portion 67 thereof, has a plurality of longitudinal slots 68 extending from the annular shoulder to the location of the first collar 55. These slots facilitate initial assembly of the sprinkler by permitting inward flexing of the shoulder, thereby permitting the jacket portion 53 of the spray tube crank 47 to be slidably mounted in its operational location encircling the sleeve, prior to the securing of the sleeve to the spray tube 23

The detent 38 comprises a teat 60, which is formed on the abutting face of the first collar 55, and a recess 61, which is formed in the abutting face of the second collar 57. The teat and the recess preferably have generally conforming shapes, with tapered sidewalls forming obtuse angles with the respective abutting faces of the first and second collars. Under normal operating conditions, the teat 60 engages the recess 61, thereby coupling rotational movement of the jacket 53 to the sleeve 24, and in turn, to the spray tube 23.

As illustrated, the first collar 55 is formed with a semi-circular slot 69, centered at the location of the teat 60, and an arcuate flange 70, located on the face opposite the abutting face and extending over most of the first collar's circumference. The slot 69 and the arcuate flange 70 provide the first collar 55 with the requisite flexability to permit the teat 60 to slide up and out of the recess 61, thereby disengaging the detent 38 whenever the first collar 55 and second collar 57 receive substantial counter-rotational forces. Such forces can commonly occur when the sprinkler is accidentally dropped or kicked in such a fashion that the spray tube 23 receives a substantial glancing blow.

A glancing blow to the spray tube 23 is transformed, at least in part, into a rotational force which is resisted substantially only by the detent 38. When this rotational force exceeds a predetermined level, the teat 60 slidably rotates out of the recess 61, thereby permitting the spray tube 23 to yieldably deflect away from the blow. With the detent disengaged, the top of the teat rests on a portion of the abutting face of the second collar 57, as illustrated in FIG. 5, and is maintained there by the pressure from the flexed first collar 55.

While the spray tube 23 is deflected from its ordinary operational alignment, the sprinkler can continue to operate, but with the spray tube's water outlet ports 27 misdirecting the water spray. Proper operational alignment can be restored by manually rotating the spray tube 23, relative to the remainder of the sprinkler, until the teat 60 again engages the recess 61. To facilitate the manual re-alignment, the first collar 55 and the second collar 57 are provided with alignment indicators 71 and 73, respectively, which will be in angular registration when the alignment is proper.

From the foregoing description, it should be apparent that the present invention provides an improved oscillating wave lawn sprinkler having a spray tube that is capable of withstanding impacts of substantial magnitude without being damaged. The sprinkler achieves this capability in a relatively inexpensive, yet highly reliable, fashion.

Although the lawn sprinkler of the invention has been described with reference to one preferred embodiment, it will be understood by one skilled in the art that modifications may be made that will still embody the spirit and scope of the invention described herein.

I claim:

1. In an ocillating wave type lawn sprinkler including a base; a motor housing located at one end of the base; a support arbor located at the other end of the base; a spray tube assembly having a spray tube journaled at a first end in the housing and at a second end in the arbor; a fluid actuated motor located in said housing; and a spray tube linkage assembly coupled between said motor and said spray tube assembly, for transforming rotational motion of said motor into angularly oscillatory motion of said spray tube, the improvement comprising:

releasable coupling means for releasably coupling said linkage assembly to said spray tube assembly, said coupling means including a first collar secured to a portion of said spray tube and projecting outwardly therefrom, a second collar secured to a portion of said linkage assembly and adapted to be maintained in abutment with said first collar, and a detent carried by said first and second collars, said detent including a recess, a teat for engaging said recess, and deflection means formed in one of the collars permitting a portion of the collar to flex out of abutment with the other of said collars, thereby permitting said teat to disengage from said recess, whereby said detent yieldably disengages whenever said spray tube is subjected to an externally applied rotational force exceeding a predetermined magnitude, said disengagement permitting said spray tube to angularly deflect away from the force.

2. An oscillating wave type lawn sprinkler comprising:

a body having a base, a motor housing located at one end of said base, and a support arbor located at the other end of said base; a said motor housing having a fluid inlet and a fluid outlet, whereby fluid is allowed to flow therethrough;

a spray tube assembly having a spray tube journaled at a first end in said housing and at a second end in said arbor;

a fluid-actuated motor having a drive shaft extending outwardly through a wall of said housing, said flow of fluid through said housing effecting a rotational motion of said drive shaft;

a spray tube linkage assembly coupled between said drive shaft and said spray tube assembly, for transforming the rotational motion of said drive shaft into angularly oscillatory motion of said spray tube, said linkage assembly including a spray tube crank having a jacket portion that encircles said spray tube assembly, said crank being driven in an angularly oscillatory fashion about the axis of rotation of said spray tube; and releasable coupling means for coupling the spray tube crank of said linkage to assembly to said spray tube assembly, said coupling means including a first collar secured to said spray tube assembly and projecting radially outwardly there from, a second collar secured to the jacket portion of said spray tube crank and projecting radially outwardly therefrom, in abutment with said first collar, and a detent having a teat located on said first collar, a recess located on second collar and adapted to be engaged by said teat, said teat and recess having tapered sidewalls forming obtuse angles with the respective abutting faces of said first and second collars, and deflection means for permitting at least a portion of said first and second collars to deflect out of mutual abutment, thereby permitting said teat to disengage from said recess, said deflection means including means defining an arcuate slot in said first collar, said slot being centered substantially at the circumferential location of said teat, and an arcuate flange located on said first collar and extending over at least a major portion of the circumference of said first collar, whereby said spray tube is permitted to angularly deflect out of its normal operational alignment when subjected to an externally applied rotational force exceeding a predetermined magnitude.

3. An oscillating wave type lawn sprinkler as defined in claim 2, wherein said spray tube assembly includes a sleeve, encircling said spray tube and secured thereto, said jacket portion of said spray tube crank encircles said sleeve, said first collar is secured to said sleeve near a first end of said sleeve, and said sleeve has a radially outwardly projecting annular shoulder at a second end thereof, whereby said jacket portion is prevented from sliding axially along said sleeve.

4. An oscillating wave type lawn sprinkler as defined in claim 3, wherein said sleeve, including said annular shoulder, is longitudinally slotted over a major portion of its length.

5. An oscillating wave type lawn sprinkler comprising:

a body having a base, a motor housing located at one end of said base, and a support arbor located at the other end of said base; said motor housing having a fluid inlet and a fluid outlet, whereby fluid is allowed to flow therethrough;

a spray tube assembly including a spray tube journaled at a first end in said housing and at a second end in said arbor, and a sleeve encircling said spray tube and secured thereto;

a fluid-actuated motor having a drive shaft extending outwardly through a wall of said housing, said flow of fluid through said housing effecting a rotational motion to said drive shaft;

a spray tube linkage assembly coupled between said drive shaft and said spray tube assembly, for transforming the rotational motion of said drive shaft into angularly oscillatory motion of said spray tube said linkage assembly including a spray tube crank having a jacket portion that encircles the sleeve of said spray tube assembly, said crank being driven in an angularly oscillatory fashion about the axis of rotation of said spray tube assembly; and releasable coupling means for coupling the spray tube crank of said linkage assembly to the sleeve of said spray tube assembly, said coupling means including a first collar secured to a first end of said sleeve and projecting radially outwardly therefrom, a second collar secured to a first end of said jacket and projecting radially outwardly therefrom, in abutment with said first collar, an annular shoulder secured to a second end of said sleeve and projecting radially outwardly therefrom, to abut a second end of said jacket, thereby cooperating with said first collar to prevent said jacket from sliding axially along said sleeve, and a detent having a recess located in one of said first and second collars, a teat to engage said recess located on the other of said first and second collars, and deflection means for permitting at least a portion of said first and second collars to deflect out of mutual abutment, thereby permitting said teat to disengage from said recess whereby said spray tube is permitted to angularly deflect out of its normal operational alignment when subjected to an externally applied rotational force exceeding a predetermined magnitude.

6. In an oscillating wave lawn sprinkler of the new type having a spray tube, a fluid-acutated motor, and a linkage assembly coupled between the motor and the spray tube for transforming rotational motion of the motor into angularly oscillatory motion of the spray tube, the improvement comprising:

means for releasably coupling the linkage assembly to the spray tube, said coupling means including a first collar secured to a portion of said spray tube and projecting radially outwardly therefrom, a second collar secured to a portion of said linkage assembly and adapted to be maintained in abutment with said first collar, and a detent carried by said first and second collars, said detent including a recess, a teat for engaging said recess, and deflection means formed in one of the collars for permitting at least a portion of the collar to flex out of abutment with the other of said collars, thereby permitting said teat to disengage from said recess, whereby said spray tube is permitted to angularly deflect out of its normal operational alignment when subjected to an externally applied rotational force exceeding a predetermined magnitude.

7. Apparatus as defined in claim 6, wherein:

said deflection means includes a slot formed in one of said first and second collars.

8. Apparatus as defined in claim 7, wherein:

said slot is arcuate, and said deflection means further includes an arcuate flange located adjacent said arcuate slot, said flange extending over a major portion of the circumference of the collar.

9. Apparatus as defined in claim 6, wherein:

said teat and said recess have tapered sidewalls forming obtuse angles with the abutting faces of said first and second collars, thereby facilitating disengagement of said teat from said recess.

10. Apparatus as defined in claim 6, wherein said releaseable coupling means further includes:

a jacket that encircles said spray tube, said second collar being secured to a first end of said jacket, an annular shoulder secured to a portion of the spary tube and projecting radially outwardly therefrom, to abut a second end of said jacket, thereby cooperating with said first collar to prevent said jacket from sliding axially along said spray tube.

* * * * *